United States Patent [19]

Wendt

[11] 4,329,820

[45] May 18, 1982

[54] MOUNTING STRIP WITH CARPET GRIPPING MEANS FOR RELOCATABLE PARTITION WALLS

[75] Inventor: Alan C. Wendt, Barrington, Ill.

[73] Assignee: United States Gypsum Company, Chicago, Ill.

[21] Appl. No.: 141,837

[22] Filed: Apr. 21, 1980

[51] Int. Cl.[3] ..... E04B 2/82

[52] U.S. Cl. ..... 52/241

[58] Field of Search ..... 52/241, 242, 402, 238; 16/4, 7, 8

[56] References Cited

U.S. PATENT DOCUMENTS

| | | | |
|---|---|---|---|
| 1,041,645 | 10/1912 | MacDowney . | |
| 2,942,289 | 6/1960 | Linsky . | |
| 2,976,970 | 3/1961 | Toney . | |
| 3,017,672 | 1/1962 | Vaughan . | |
| 3,228,160 | 1/1966 | O'Brien | 52/242 |
| 3,324,615 | 6/1967 | Zinn | 52/241 |
| 3,438,164 | 4/1969 | Duepree | 52/282 |
| 3,460,302 | 8/1969 | Cooper | 52/242 |
| 3,462,904 | 8/1969 | Napier | 52/242 |
| 3,753,328 | 8/1973 | Papsco | 52/241 |
| 3,894,366 | 7/1975 | Arnett | 52/37 |
| 3,995,405 | 12/1976 | Peterson | 52/627 |
| 4,080,766 | 3/1978 | Jastrabek | 52/242 |
| 4,147,005 | 4/1979 | Meyer | 52/397 |

*Primary Examiner*—J. Karl Bell

*Attorney, Agent, or Firm*—Jerome J. Adams; Robert H. Robinson; Samuel Kurlandsky

[57] ABSTRACT

A mounting strip with carpet gripping means for relocatable partition walls is disclosed. Said mounting strip comprises a central portion having a generally rectangular configuration, support shelves integral with said central portion and extending outwardly from marginal edges thereof, a multiplicity of barbs extending downwardly from said mounting strip, locating tabs extending upwardly from said central portion along said marginal edges defining an accommodating path for floor runners therebetween. Said mounting strip is capable of gripping a carpet at said barbs and adapted to support wall panels along said support shelves and accommodate floor runners between said locating tabs. Said mounting strip is removable without harmfully affecting a carpet to permit relocation of a movable partition wall construction mountable thereon.

18 Claims, 7 Drawing Figures

MOUNTING STRIP WITH CARPET GRIPPING MEANS FOR RELOCATABLE PARTITION WALLS

BACKGROUND OF THE INVENTION (1) Field of the Invention

The invention relates to a mounting strip with carpet gripping means for relocatable partition walls.

(2) Description of the Prior Art

Movable partition walls are often installed over fully carpeted areas to eliminate any carpet patching when the movable partitions are relocated. Power driven fasteners, which are typically used in this type of installation, are driven through the floor runner, carpet, and into the floor. Upon removal of these penetrating fasteners, damage to the floor and carpeting may occur. If the floor is concrete, when the penetrating fasteners are removed, the concrete surface crumbles into mounds, thereby causing visible bulges in the carpeting. Damage also may occur as a result of the partition weight crushing carpet fibers.

With the desirability of relocating partition walls in carpeted areas, such as in offices, schools and residential recreational areas, it would be desirable to allow such versatility without damage to flooring and carpeting. It would also be very useful to provide a mounting strip which may be relocated and reusable at other locations for movable partition wall systems.

(3) Objects of the Invention

It is accordingly a primary object of the invention to provide a mounting strip for mounting relocatable partition walls over carpeted flooring without damage to carpet fibers or flooring.

It is also a goal of the invention to provide a mounting strip which can accommodate floor runners disposed between spaced apart rows of partition walls.

It is an allied object of the invention to provide a mounting strip which provides support shelves for mounting wall panels thereon and avoids damage to carpeting.

It is additionally a goal of the invention to provide a mounting strip which is easily affixed to carpeted flooring and may be readily removed without damage to the carpet or the floor below.

It is a concomitant goal of the invention to provide a mounting strip that is capable of gripping a carpet and adapted to support wall panels thereon, which resists lateral movement of the floor runner and eliminates normally required floor fasteners.

SUMMARY OF THE INVENTION

In satisfying all the aims, objects and goals of the invention as set forth, a mounting strip with carpet gripping means for relocatable partition walls is provided. The mounting strip comprises a central portion having a generally rectangular configuration, support shelves integral with said central portion and extending outwardly from marginal edges thereof, a multiplicity of barbs extending downwardly from said mounting strip, and locating tabs extending upwardly from said central portion along said marginal edges defining an accommodating path for floor runners therebetween. Said mounting strip being capable of gripping a carpet at said barbs and adapted to support wall panels along said support shelves while accommodating floor runners between said locating tabs. Whereby said mounting strip is movable without harmfully affecting a carpet to permit relocation of a movable partition wall construction mounted thereon.

Further aims and objects of the invention are attained by the provision of a movable partition wall constructed over a carpeted floor. Said partition wall comprises two spaced-apart rows of panels with studs supporting said panels at wall panel joints and floor runners extending between said rows of panels in supportive engagement with said panels. The movable partition wall further includes a mounting strip for accommodating said floor runners and supporting said wall panels. The mounting strip comprises a central portion, integral support shelves extending outwardly from marginal side edges of central portion, a multiplicity of carpet gripping barbs extending downwardly from said mounting strip, and locating tabs extending upwardly from said central portion and being spaced apart a sufficient distance to accommodate said floor runners therebetween. The wall panels of said movable partition wall being supported along the support shelves and said floor runners disposed between said locating tabs. The movable partition wall constructed over a carpeted floor further includes a floor with covering comprising carpeting wherein said carpeting is gripped by the barbs of the mounting strip and supporting said mounting strip thereon. Wherein said partition wall construction is demountable and said mounting strip is disengageable from said carpeting without harmfully affecting said carpet and floor.

DESCRIPTION OF THE PREFERRED EMBODIMENTS

Figure 1:
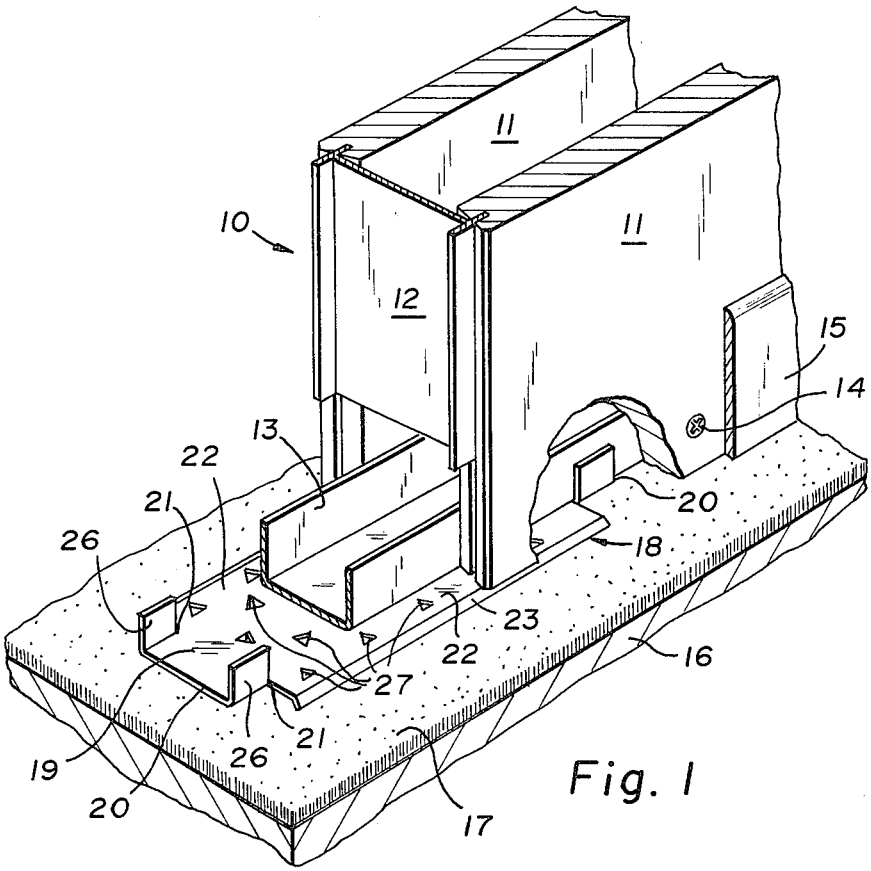
FIG. 1 is a perspective view partially broken away showing the mounting strip of this invention in its preferred embodiment for use with a conventional partition wall.

FIG. 1 illustrates the use of this invention with a conventional partition wall 10. Conventional partition wall 10 is easily removable in a fashion widely known to the industry and as such the ability to mount it over carpeted flooring is desirable. Conventional partition wall 10 comprises spaced apart wall panels 11 meeting at joints and interengaged by studs 12, which have a general H-shape. Other widely used removable studs configurations are equally suitable for use with this invention as would be well understood. Disposed between, and supportive thereof, wall panels 11 is floor runner 13. Floor runner 13 comprises a conventional channel-shape suitable for affixation of wall panels 11 by means of screw fasteners 14. Screw fasteners 14 are conventionally known dry wall screws for such purposes. Along lower portions of wall panels 11, covering screw fasteners 14 and providing a decorative appearance, is base trim 15. Base trim 15 is shown partially removed for better illustration. Conventional partition wall 10 is supported atop floor 16 having a covering comprising carpet 17. In order to provide for such removability, it is very desirable to allow conventional partition wall 10 to be removed without damage to the fibers of carpet 17 or to floor 16. In satisfaction thereof, mounting strip 18 is provided for utilization with conventional partition wall 10 to attain these goals.

Figure 2:
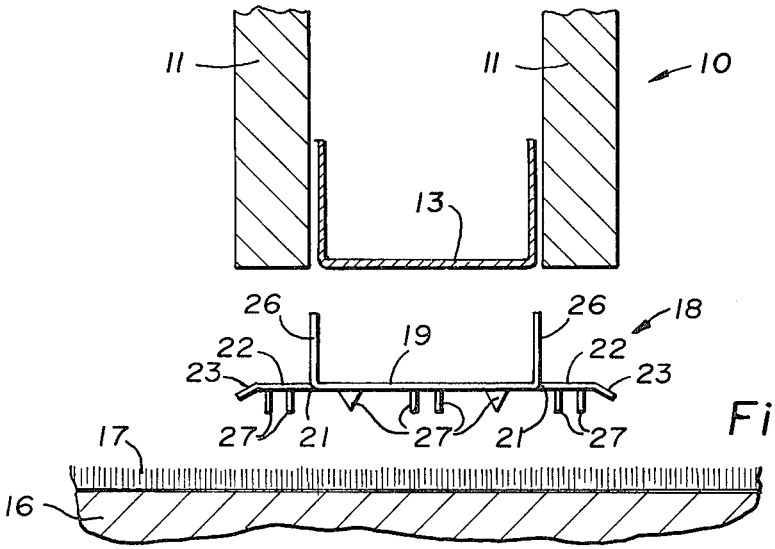
FIG. 2 is an end view of the inventive mounting strip of this invention shown in an exploded alignment with a conventional partition wall as shown in FIG. 1.

To more fully describe the utilization of mounting strip 18, joint reference is now made to FIGS. 1 and 2. In its preferred form, mounting strip 18 comprises a central portion 19 having opposite ends 20 and opposite marginal edges 21. Central portion 19 thus has a generally rectangular-shape. Extending adjacent central portion 19 are support shelves 22 integrally connected at opposite marginal edges 21 of central portion 19. In its preferred form, support shelves 22 and central portion 19 are co-planar. Support shelves 22 are thus envisioned as being continuing planar adjacent surfaces for support of wall panels 11 thereon. In order to facilitate ease of installation, support shelves 22 terminate at downwardly angled lip portions 23. Thus, wall panels 11 may be positioned atop support shelves 22 in a facile manner. Mounting strip 18 accommodates floor runner 13 by means of locating tabs 26. Locating tabs 26 are struck out from mounting strip 18 generally along opposite marginal edges 21 of central portion 19. In the preferred form, locating tabs 26 are struck out adjacent opposite ends 20. In this formation, a mounting strip 18 is provided at stud 12 locations at joints between wall panels. Thereby, each wall panel will be supported at its opposite edges by a mounting strip 18 at stud 12 locations. In order to accommodate sufficient supportive engagement for conventional partition wall 10, mounting strip 18 is provided in a preferred length of from about 4" to about 12" . To afford resistance to lateral forces and to securely maintain conventional partition wall 10 in place, barbs 27 are provided. Barbs 27 are struck downward from mounting strip 18 for engagement with carpet 17. Preferably, barbs 27 are struck out downwardly from both central portion 19 and support shelves 22. Barbs 27 are provided both in longitudinal and transverse alignments for proper securement as shown in FIG. 2 more clearly. It is however within the scope of the invention, that barbs 27 may only be struck out from central portion 19 or from support shelves 22. This is envisioned within the range of construction for mounting strip 18.

Continuing further with FIGS. 1 and 2, mounting strip 18 is shown to be an easily positioned means for support of conventional partition wall 10 while yet affording proper support for wall panels 11. By supporting wall panels 11 atop support shelves 22, crushing of carpet fibers of carpet 17 is minimized. Moreover, in previous carpet mounting designs, mechanical fasteners would be driven into floor 16 through carpet 17. Such fasteners may be nails, screws, or other driven mechanical fasteners. One of the problems which the invention solves is the elimination of damage to both carpet and flooring incidental to such fastening techniques. When these previously used fasteners are removed in order to relocate or completely remove a conventional partition wall, damage to the floor may be evident by mounds of material which are left as the fasteners are removed. Plus, carpet fibers may be torn or shreaded at such engagement points. Thus mounting strip 18 alleviates these problems while yet affording excellent supportive engagement for conventional partition wall 10.

Figure 3:
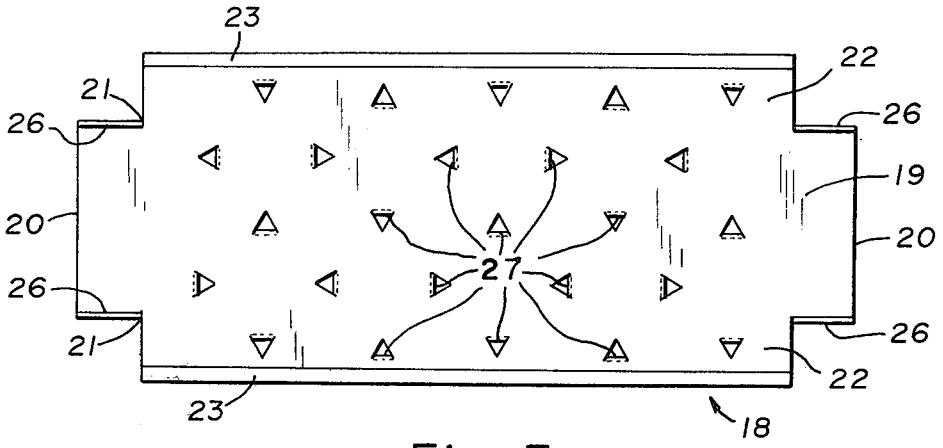
FIG. 3 is a top view of the mounting strip as shown in FIG. 2.
Figure 4:
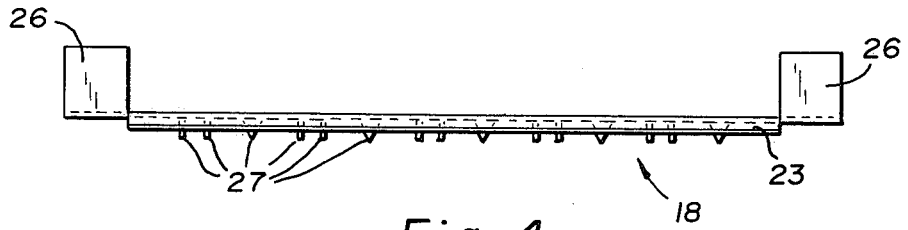
FIG. 4 is a side view of the mounting strip as shown in FIG. 2.
Figure 5:
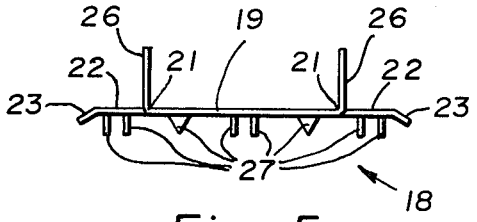
FIG. 5 is an end view of the mounting strip, alone, similar to FIG. 2.

With more specific regard to mounting strip 18, reference is now made to FIGS. 3, 4 and 5. FIG. 3 shows mounting strip 18 from a top view. As can be seen, central portion 19 is generally provided as existing between locating tabs 26 wherein opposite marginal edges 21 are the imaginary parallel lines extending longitudinal of mounting strip 18 generally in line with locating tabs 26. Support shelves 22 extend adjacent central portion 19 along opposite marginal edges 21 and are integral therewith. Support shelves 22 are provided to accommodate the particular width of wall panels 11 used. Such widths are of a conventional dimension of from about $\frac{3}{8}$" to about 1". The width of central portion 19 is provided to accommodate floor runner 13 between locating tabs 26. Accordingly, the width of central portion 19 can vary with the particular dimension of floor runner 13 used. Such dimension may be in the range of from about 1" to about 4" depending on the wall construction. Mounting stip 18 is preferrably comprised of steel and may be manufactured by conventional equipment. A preferrable thickness is 26 gauge (0.0217") and comprises hot dipped galvanized steel. The range of gauges for mounting strip 18 is not critical but it is envisioned that such thickness would be most suitably found in the ranges of from between 18 gauge to 30 gauge. The lip portions 23 generally incline downwardly at a preferred angle of about 30° for positioning wall panels 11 thereon. Such downward angle is again not critical and may be provided in a range of from about 0° to about 45°. Additionally, the length of mounting strip 18, in the preferred form, is about 8" with about twenty five barbs 27 struck downwardly from both central portion 19 and support shelves 22, as previously described. In order to facilitate resistance to both lateral forces and longitudinal forces, approximately half of barbs 27 will be oriented longitudinal of mounting strip 18 with the remainder transverse. It is additionally envisioned that barbs 27 do not extend downwardly from that part of central portion 19 between locating tabs 26, but may, however, be alternately provided at these locations within the scope of the invention. Lip portions 23 may alternately be deleted and mounting strip 18 would simply afford support shelves 22 for positioning of wall panels 11 thereon. Base trim 15, which would be lastly installed, covers screw fasteners 14 and covers lip portions 23, if provided.

Figure 6:
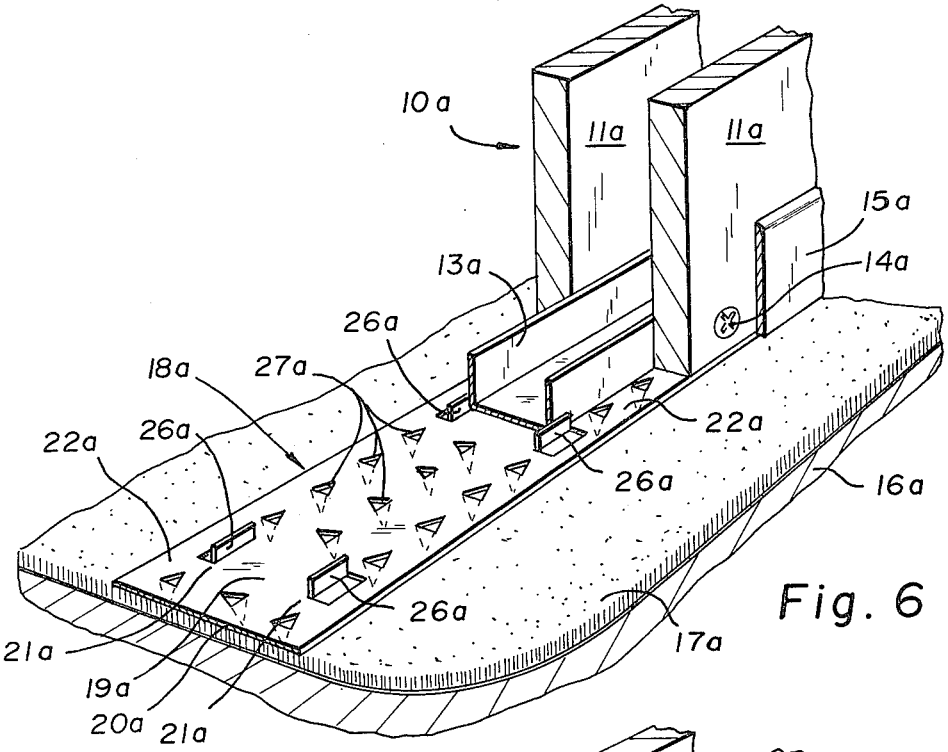
FIG. 6 is an alternate preferred embodiment for the mounting strip as installed with a conventional partition wall in a partially exposed perspective view.

Turning now to FIG. 6, an alternate preferred embodiment for the invention is shown as mounting strip **18*a*. Similar reference numerals in FIG. 6 correspond to reference numerals previously mentioned with regard to FIGS. 1–5. Whereby, conventional partition wall 10*a* is shown with wall panels 11*a* spaced apart in parallel relationship. 13*a* is shown for affixation of wall panels 11*a* by means of screw fasteners 14*a* passing therethrough. In this embodiment base trim 15*a* is again provided for decorative covering of screw fasteners 14*a*. Conventional partition wall 10*a* is supported atop floor 16*a* covered by carpeting 17*a*. Conventional partition wall 10*a* has wall panels 11*a* supported along mounting strip 18*a* with all panels 11*a* resting upon support shelves 22*a*. Mounting strip 18*a* has central portion 19*a* with opposite ends 20*a* and opposite marginal edges 21*a*. Central portion 19*a* has an elongate rectangular configuration. In this embodiment, mounting strip 18***a* is provided for the full extent of wall panels 11*a* and thus bottom surfaces of wall panels 11*a* rest for their full length atop support shelves 22*a* as shown. In this Figure support shelves 20*a* do not include lip portions but lip portions could be provided as previously discussed. For accommodation and positioning of floor runners 13*a*, locating tab 26*a* are struck upwardly from mounting strip 18*a* generally along opposite marginal edges 21*a* of central portion 19*a*. Support shelves 22*a* are integral with, and adjacent to, central portion 19*a* and a co-planar relationship is thereby provided. In the embodiment of FIG. 6 mounting strip 18*a* has locating tabs 26*a* at spaced-apart intervals along opposite marginal edges 21*a* intermediate opposite ends 20*a*, rather than adjacent opposite ends 20*a*. It is preferable that locating tabs 26*a* be provided in opposing pairs at these spaced-apart intervals. Thus, a symmetric relationship is disclosed for ease of manufacture and installation. However, locating tabs 26*a* may be staggered along either side as would be well understood. Mounting strip 18*a* may be provided in varying lengths. A single mounting strip 18*a* could be provided for the full extent of a wall panel 11*a*, wherein a conventional wall panel 11*a* width would be from about 24" to about 48". Longer lengths could be manufactured for extension beneath all or most of a wall construction. Lengths could also be provided equal to, or less than, the widths of panels and as such a series of mounting strips 18*a* could be abutted end-to-end. Barbs 27*a* are shown struck downwardly from mounting strip 18*a* both along central portion 19*a* and support shelves 22*a*. However, within the scope of this invention, and within the ambit of the alternate preferred embodiment from mounting strip 18*a*, barbs 27*a* may be struck downwardly only from central portion 19*a*, or only from support shelves 22*a*. Barbs 27*a*, similar to barbs 27 of the embodiment for mounting strip 18, are desirably provided both longitudinal and transverse of mounting strip 18*a* to afford resistance to both lateral and longitudinal forces in supportive engagement with carpet 17*a*. However, all, or a majority, of barbs could be provided parallel of mounting strip when longitudinal forces are not anticipated. The distance between locating tabs 26*a* across central portion 19*a* corresponds to the particular dimension for the particular floor runner 13*a* width utilized. Such dimension is typically in the range up from about 1" to about 4".

Figure 7:
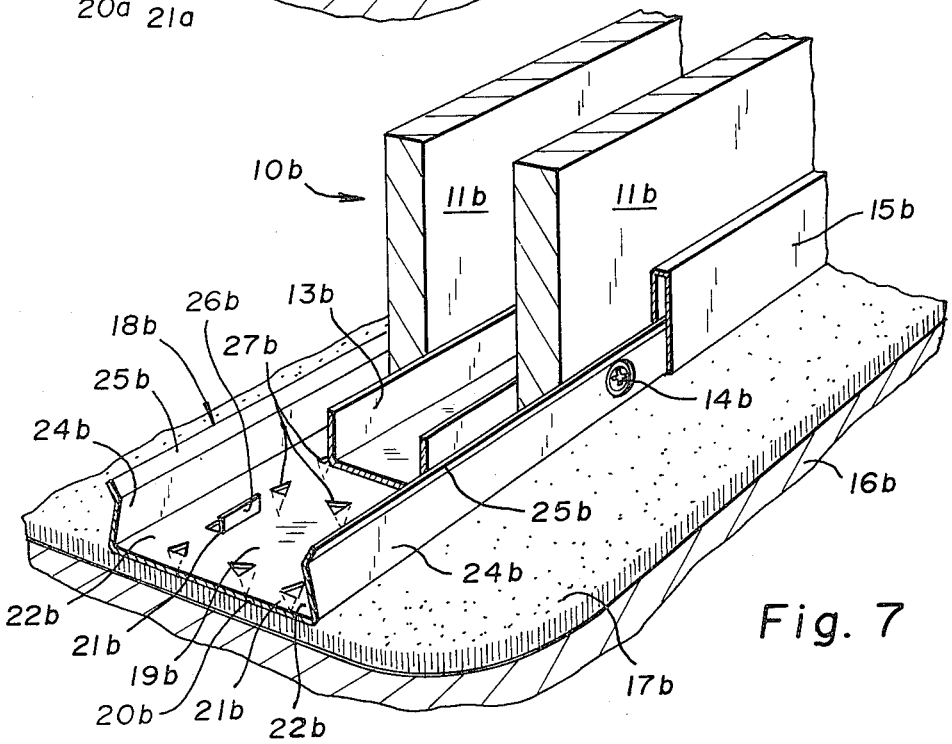
FIG. 7 is another alternate preferred embodiment for the mounting strip of this invention shown in a perspective view for use with a conventional partition wall.

With reference now taken to FIG. 7, another alternate embodiment for the mounting strip of this invention is shown as mounting strip 18*b*. Mounting strip 18*b* is shown supporting wall panels 11*b* of conventional partition wall 10*b*. Conventional partition wall 10*b* utilizes wall panels 11*b* in a spaced-apart relationship meeting at joints. Floor runner 13*b* is disposed for affixation of screw fasteners 14*b* for supportive engagement of wall panels 11*b* thereto. Mounting strip 18*b* provides central portion 19*b* having opposite ends 20*b* and opposite marginal edges 21*b*. Support shelves 22*b* extend adjacent and integrally from central portion 19*b* along marginal edges 21*b*. Similarly, support shelves 22*b* and central portion 19*b* extend in the same plane. Support shelves 22*b* are provided in widths to accommodate the particular wall panel 11*b* widths involved. In the alternate preferred embodiment shown in FIG. 7, mounting strip 18*b* is characterized by the provision wherein support shelves 22*b*, rather than terminating in lip portions, terminate in upwardly extending flanges 24*b*, which in turn terminate at upper portions in outwardly angled lip portions 25*b*. Thus, wall panels 11*b* are disposed between locating tabs 26*b* and upwardly extending flanges 24*b*. The outwardly angled lip portions 25*b* facilitate positioning of wall panels 11*b* upon support shelves 22*b*. In this embodiment, a base trim 15*b* is provided in a slotted configuration for nesting atop upwardly extending flanges 24*b* as shown. Thereby base trim 15*b* decoratively covers screw fasteners 14*b* to provide an esthetically pleasing base portion. Locating tabs 26*b* are again preferably provided in opposing pairs at spaced apart intervals along opposite marginal edges 21*b* of central portion 19*b*. Mounting strip 18*b*, similar to alternate preferred embodiment 18*a*, could be provided for continuous support of wall panels 11*b* along support shelves 22*b*, or may also be provided in shorter lengths for location at joints similar to the preferred embodiment for mounting strip 18. One length, or a multiplicity of strips, may be provided. When more than one length is used, mounting strips 18*b* could abut end-to-end to provide said continuous support, as would be well understood. In the preferred embodiment, wall panels 11*b* rest completely atop support shelves 22*b* over carpeting 17*b*. Damage to floor 16*b* and carpet 17*b* is minimized allowing removability of conventional partition wall 10*b* therefrom. The thickness of mounting strip 18*b*, as well as 18*a*, corresponds to the dimensions previously discussed, for mounting strip 18.

In the embodiments of conventional partition walls 10, 10*a*, and 10*b*, channel-shaped floor runners and H-shape studs are envisioned. However, other demountable partition assemblies utilizing other configurations can be accommodated within the scope of this invention. The accommodation of floor runners 13, 13*a* and 13*b* between locating tabs 26, 26*a* and 26*b* affords positive installation. It is also to be noted that the upwardly extending flanges 24*b* of mounting strip 18*b* may extend upwardly and angle inwardly from support shelves 22*b*, as shown in FIG. 7, and are not limited to a right angle intersection thereto. Barbs 27*b* of mounting strip 18*b*, as shown in FIG. 7, may be struck downward from both central portion 19*b* and support shelves 22*b*, or from either of those portions, sufficient to resist lateral and longitudinal forces affecting conventional partition wall 10*b*.

Thus it is seen that a mounting strip has been provided for utilization with conventional partition wall construction permitting demountability from a carpeted floor surface without damage to the flooring or the carpeting. While the invention has been described in conjunction with specific embodiments thereof, it is evident that many alternatives, modifications, and variations will be readily apparent to those skilled in the art in light of the foregoing description. Accordingly, it is intended to embrace all such alternatives, modifications, and variations as fall within the spirit and broad scope of the appended claims.

What is claimed is:

1. An integral mounting strip for relocatable partition walls comprising means for gripping subjacent carpeting, said mounting strip comprising:

a central portion having a generally rectangular configuration;

support shelves integral with said central portion and extending outwardly from marginal edges thereof;

a multiplicity of barbs extending downwardly from said mounting strip;

locating tabs extending upwardly from said central portion along said marginal edges defining an accommodating path for floor runners therebetween;

wherein said mounting strip grips said subjacent carpeting at said barbs and is adapted to support wall panels along said support shelves and to accommodate floor runners between said locating tabs, whereby said mounting strip is removable without harmfully affecting a carpet to permit relocation of a removable wall construction mountable thereon.

2. A mounting strip with carpet gripping means for relocatable partition walls as in claim 1 wherein said support shelves terminate in downwardly angled lip portions facilitating positioning wall panels on said support shelves.

3. A mounting strip with carpet gripping means for relocatable partition walls as in claim 1 wherein said locating tabs are struck-out from said mounting strip in opposing pairs to define the floor runner accommodating path therebetween.

4. A mounting strip with carpet gripping means for relocatable partition walls as in claim 3 wherein said locating tabs are struck-out at opposite ends of said mounting strip and said mounting strip includes two pairs of locating tabs.

5. A mounting strip with carpet gripping means for relocatable partition walls as in claim 4 wherein said mounting strip has a length of from about 4 inches to about 12 inches, said mounting strip being adapted for positioning at wall panel joints and to be provided at spaced-apart distances occurring at joints.

6. A mounting strip with carpet gripping means for relocatable partition walls as in claim 1 wherein said barbs extend from said central portion.

7. A mounting strip with carpet gripping means for relocatable partition walls as in claim 1 wherein said barbs extend from said support shelves.

8. A mounting strip with carpet gripping means for relocatable partition walls as in claim 1 wherein said barbs extend from said central portion and support shelves.

9. A mounting strip with carpet gripping means for relocatable partition walls as in claim 1 wherein said support shelves terminate in upwardly extending flanges adapted for inverted engagement by decorative U-shaped or J-shaped base trim pieces.

10. A mounting strip with carpet gripping means for relocatable partition walls as in claim 9 wherein said flanges includes spaced-apart holes for accommodation of screw fasteners extending therethrough for screw fastener engagement of wall panels mountable along said support shelves.

11. A movable partition wall constructed over a subjacent carpeted floor, said partition wall comprising:

two spaced apart rows of wall panels;

studs supporting said panels at wall panel joints;

a floor runner extending between said rows of panels in supportive engagement thereof;

an integral mounting strip accommodating said floor runner and supporting said wall panels, said mounting strip comprising a central portion, integral support shelves extending outwardly from marginal side edges of said central portion, a multiplicity of carpet gripping barbs extending downwardly from said mounting strip for gripping said subjacent carpeting, locating tabs extending upwardly from said central portion and being spaced apart the width said central portion a sufficient distance to accommodate said floor runner therebetween;

said wall panels being supported along the support shelves;

said floor runner disposed between said locating tabs;

a floor with covering comprising carpeting, said carpeting being gripped by said barbs and supporting said mounting strip;

wherein said partition wall construction is demountable and said mounting strip is disengageable from said carpeting without harmfully affecting said carpet and floor.

12. A movable partition wall constructed over a carpeted floor as in claim 11 wherein said support shelves of said mounting strip terminate in downwardly angled lip portions facilitating positioning wall panels on said support shelves.

13. A movable partition wall constructed over a carpeted floor as in claim 11 wherein said locating tabs are struck-out from said mounting strip in opposing pairs to define the the floor runner accommodating path therebetween.

14. A movable partition wall constructed over a carpeted floor as in claim 11 wherein said locating tabs of said mounting strip are struck-out at opposite ends of said mounting strip and said mounting strip includes two pairs of locating tabs.

15. A movable partition wall constructed over a carpeted floor as in claim 14 wherein said partition wall includes a multiplicity of mounting strips wherein each mounting strip has a length of from about 4" to about 12" and is positioned at wall panel joints for support of opposing spaced apart wall panels at said joints.

16. A movable partition wall constructed over a carpeted floor as in claim 11 wherein the support shelves of said mounting strip extend outwardly from said central portion a distance about the same as the thickness of said wall panels.

17. A movable partition wall constructed over a carpeted floor as in claim 11 wherein said support shelves of the mounting strips terminate in upwardly extending flanges and invertedly engage decorative U-shaped or J-shaped base trim pieces along said carpeted floor.

18. A movable partition wall constructed over a carpeted floor as in claim 17 wherein said flanges include spaced apart holes accommodating screw fasteners extending therethrough for screw fastener engagement of wall panels to said floor runners.

* * * * *